US009085856B2

(12) United States Patent
Kerstjens

(10) Patent No.: US 9,085,856 B2
(45) Date of Patent: Jul. 21, 2015

(54) CLAMPING MECHANISM FOR SECURING AT LEAST ONE OBJECT, IN PARTICULAR A BARRIER, TO A RAIL, AND ASSEMBLY

(75) Inventor: Johannes Jozef Lucie Kerstjens, Holtum (NL)

(73) Assignee: Cornelius Wilhelm Robert Toussaint, Muelheim-Ruhr (DE)

( * ) Notice: Subject to any disclaimer, the term of this patent is extended or adjusted under 35 U.S.C. 154(b) by 55 days.

(21) Appl. No.: 13/983,213

(22) PCT Filed: Feb. 2, 2012

(86) PCT No.: PCT/NL2012/050059

§ 371 (c)(1),
(2), (4) Date: Oct. 1, 2013

(87) PCT Pub. No.: WO2012/105840

PCT Pub. Date: Aug. 9, 2012

(65) Prior Publication Data

US 2014/0014734 A1 Jan. 16, 2014

(30) Foreign Application Priority Data

Feb. 2, 2011 (NL) ..... 2006119

(51) Int. Cl.
*E01B 26/00* (2006.01)

(52) U.S. Cl.
CPC ..... *E01B 26/00* (2013.01); *E01B 26/005* (2013.01)

(58) Field of Classification Search
CPC ..... E01B 26/00; E01B 26/005
USPC ..... 238/17, 19, 20, 21
See application file for complete search history.

(56) References Cited

U.S. PATENT DOCUMENTS

| | | | | |
|---|---|---|---|---|
| 3,945,566 | A * | 3/1976 | Bush | 238/349 |
| 7,891,577 | B2 * | 2/2011 | Seki et al. | 238/18 |
| 8,708,287 | B2 * | 4/2014 | Ackeret et al. | 246/448 |
| 8,870,127 | B2 * | 10/2014 | Ackeret et al. | 246/453 |
| 2011/0049254 | A1 * | 3/2011 | Seki et al. | 238/17 |
| 2014/0014734 | A1 * | 1/2014 | Kerstjens | 238/310 |

FOREIGN PATENT DOCUMENTS

| | | | |
|---|---|---|---|
| FR | 2928384 | | 9/2009 |
| NL | 1030000 | | 3/2007 |
| NL | 1030000 | C2 * | 3/2007 |

OTHER PUBLICATIONS

International Search Report of PCT/NL2012/050059 dated May 21, 2012.

* cited by examiner

*Primary Examiner* — Jason C Smith
(74) *Attorney, Agent, or Firm* — Barnes & Thornburg LLP; Mark J. Nahnsen

(57) ABSTRACT

The invention relates to a clamping mechanism for securing at least one object, for example a barrier, to a rail comprising a rail web and a rail head, which clamping mechanism comprises a linkage comprising at least four rods which are pivotally interconnected via points of attachment, a short rod of which is directly connected to an upper rod and also to a bottom rod, which short rod is movable from a first position to a second position and vice versa, in which first position of the short rod the clamping mechanism can be positioned in a lateral section of the rail with some play, while in the second position of the short rod the clamping mechanism is clamped in position in the lateral section of the rail by means of the short rod.

20 Claims, 5 Drawing Sheets

Figure 1:
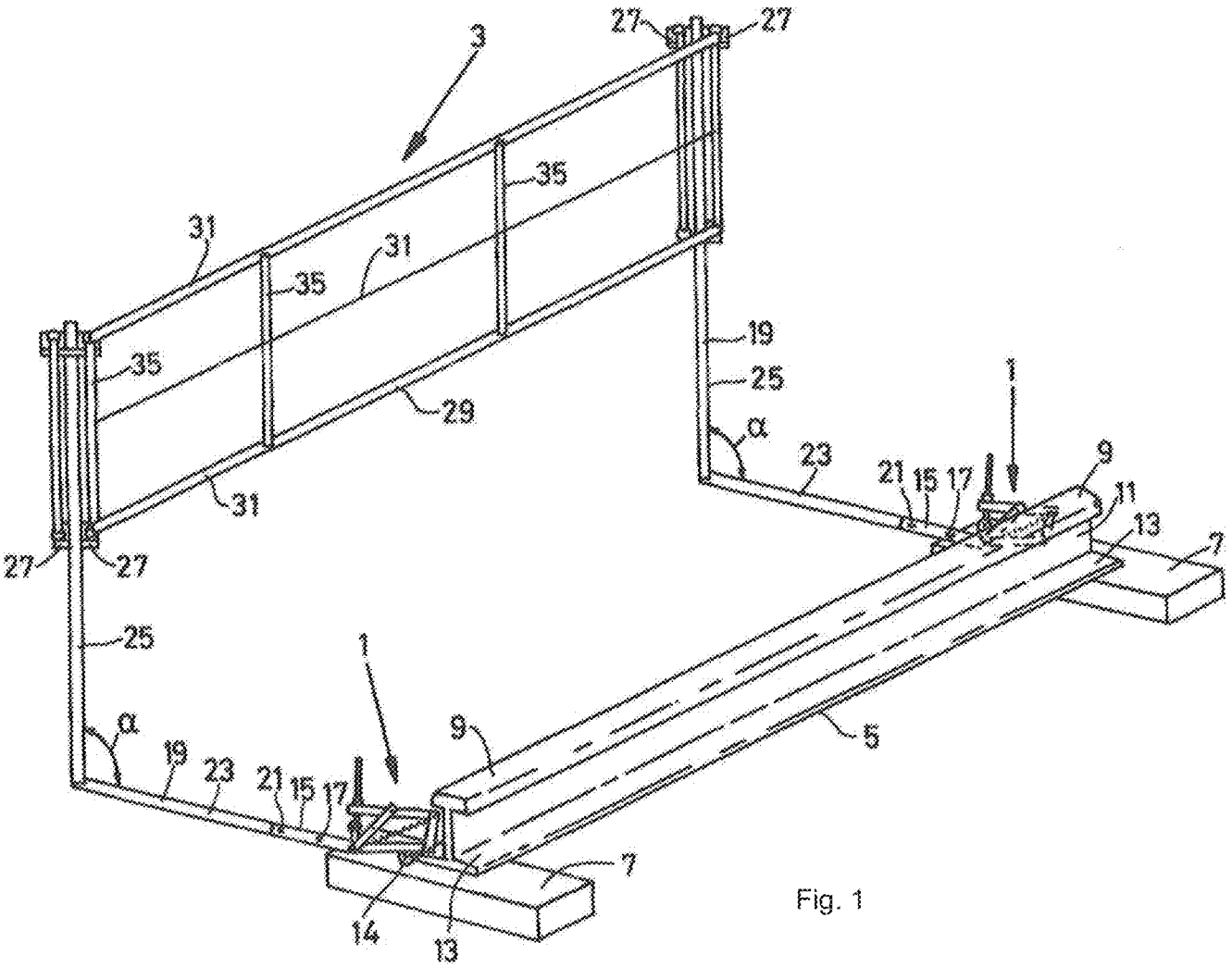

CLAMPING MECHANISM FOR SECURING AT LEAST ONE OBJECT, IN PARTICULAR A BARRIER, TO A RAIL, AND ASSEMBLY

CROSS REFERENCE TO RELATED APPLICATIONS

This application a U.S. nationalization under 35 U.S.C. §371 of International Application No. PCT/NL2012/050059, filed Feb. 2, 2012, which claims priority to NL Application No. 2006119, filed on Feb. 2, 2011 the contents of which are herein incorporated by reference in their entirety.

The invention relates to a clamping mechanism according to the preamble of claim 1 for securing at least one object, for example a barrier, to a rail.

The invention further relates to a barrier comprising such a clamping mechanism.

A clamping mechanism as referred to above is known from NL 1030000. The known clamping mechanism is used for attaching and securing a safety barrier to a railway rail. Although excellent results are obtained with the known clamping mechanism, it has been found in practice that with some rail types the clamping mechanism is relatively difficult to attach to the rail, with additional modifications being needed.

The object of the present invention is to provide a clamping mechanism that can be attached to practically any type of rail in a simpler manner.

This object is accomplished with the clamping mechanism according to the invention in that the point of attachment of the short rod to the bottom rod or the upper rod is movable substantially in the longitudinal direction of the rod in question.

In contrast to the known clamping mechanism, in which the point of attachment of the short rod to the bottom rod or at the upper rod is immovable, a point of attachment of the short rod of the clamping mechanism according to the present invention can move substantially in the longitudinal direction of the bottom rod or the upper rod for moving the short rod between the first position and the second position, in which latter position the short rod is clamped down in the lateral section of the rail with the upper rod and the bottom rod in practice. Because the short rod of the clamping mechanism according to the present invention can additionally be pivoted, the clamping mechanism according to the invention can be used for a larger number of rail types of different dimensions, even in the case of rails that deviate strongly from the standard dimension. This obviates the need to use different clamping mechanism in the case of rails having deviating dimensions, which clamping mechanisms differ from each other as regards the length of the short rod thereof, or the short rod need not be exchanged when used with a rail having a deviating dimension, which leads to an enhanced ease of use and lower installation costs. Furthermore, the clamping mechanism can be more easily positioned in the lateral section of the rail, so that the amount of labour required for attaching a clamping mechanism to the rail is minimized, which also reduces the cost of placing a safety barrier, for example, on a railway rail.

The railhead is completely clear during use of the clamping mechanism, so that a device moving on the rails will not be impeded by the clamping mechanism.

The term "lateral section of a rail" is understood to mean in particular the lateral section of a railway rail. The lateral section of a railway rail is substantially U-shaped, with the first leg of the U-shape being made up of a part of a rail head, the second leg being formed by a part of a rail foot and the bridge portion of the U-shape being formed by a intermediate portion, also referred to as the rail web, that connects the rail head and the fail foot.

One embodiment of the clamping mechanism according to the invention is characterised in that the linkage is made up of at least five pivotally interconnected rods, which five rods pivot about four pivot pins, four of which rods define a quadrangle, seen in side view, whilst a fifth push rod is directly connected to the movable point of attachment of the short rod as well as to the other three rods, among which the bottom rod and the upper rod.

The linkage comprises at least five rods, four of which form a first quadrangle, seen in side view, in the first position. The rod is can be moved to a second position by means of a locking rod, in which second position four of the five rods form a second quadrangle, seen in side view, which second quadrangle is configured so that it can be clamped down in a lateral section of a rail in a force-locked manner. The locking rod is provided with recesses, for example, in which a rod can be secured against spring force by pivoting of the locking rod. In this way the adjustment of the clamping mechanism from the first position to the second position can take place in steps. The locking rod may also be a threaded rod, onto which a nut can be screwed, which nut can be screwed against at least one of the spring-loaded rods for adjusting the clamping mechanism against spring force from the first position to the second position.

With the clamping mechanism according to the present invention, a push rod is operated simultaneously with the movement of the linkage, which push rod is directly connected to all four other rods. The push rod is connected to the movable end of the short rod and, upon movement of the rods, moves the point of attachment of the short rod in the longitudinal direction of the bottom rod or the upper rod. As a result of said movement, the shape of the quadrangle changes from a first position to a second position, in which the clamping mechanism, if placed in a lateral section of a rail, can be secured to the rail.

Another embodiment of the clamping mechanism according to the invention is characterised in that the bottom rod or the upper rod is provided with a longitudinal extending slot, in which the point of attachment of the short rod is movably accommodated.

Using such a slot, a linear and/or a curvilinear movement of the points of attachment of the short rod in the longitudinal direction of the bottom rod and/or the upper rod can be simply executed. The slot is preferably provided in the bottom rod.

The slot is furthermore preferably entirely surrounded by the rod in which it is provided.

The invention will now be explained in more detail by means of a description of an embodiment with reference to the appended figures, in which:

FIG. 1 is a perspective view of a clamping mechanism according to NL 1030000 clamped down in a lateral section of the rail, by means of which clamping mechanism a barrier is attached to the rail.

Figures 2A, 2B, 2C:
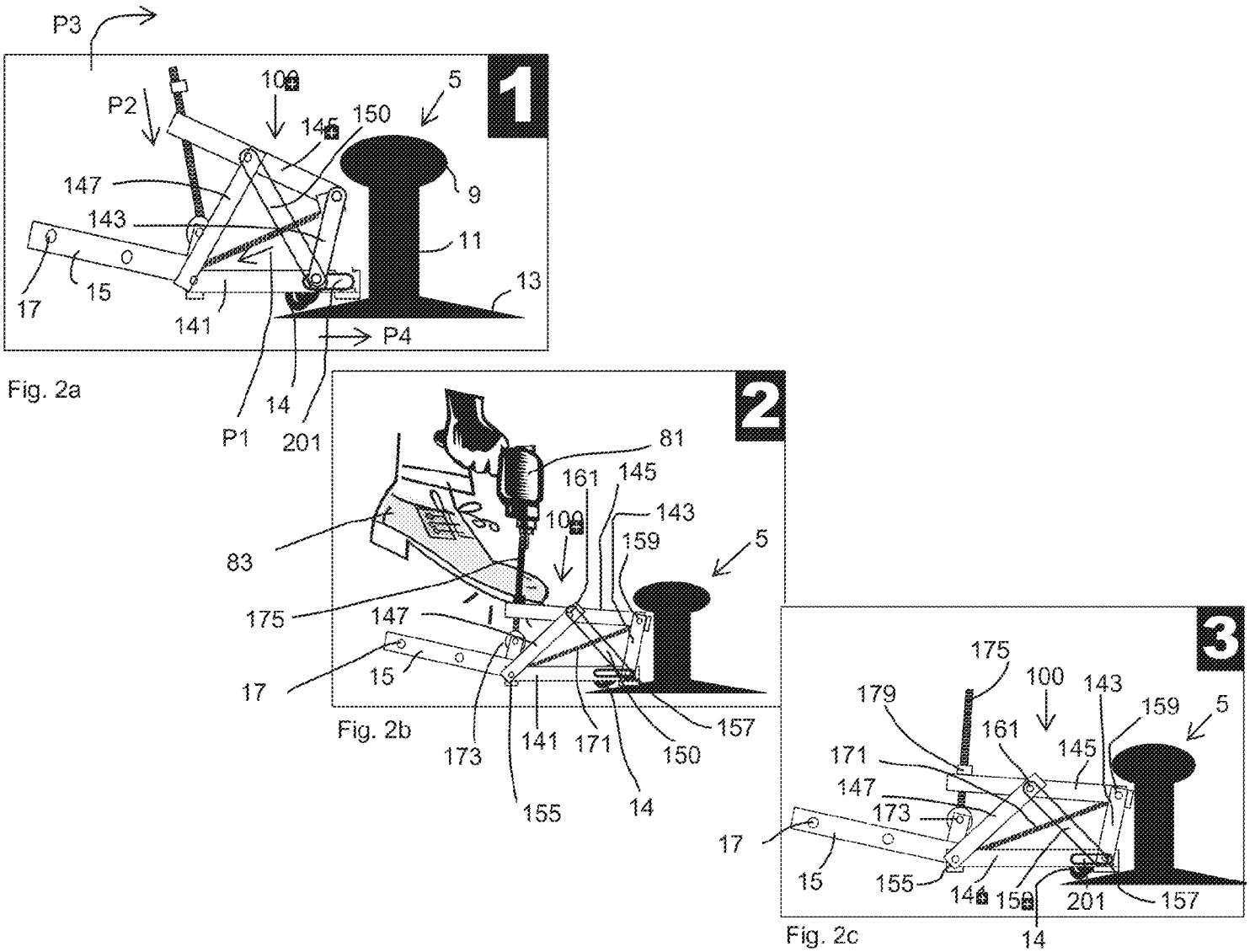

FIGS. 2*a*, 2*b* and 2*c* are schematic views showing the securing of a clamping mechanism according to the invention to a rail.

Figure 3:
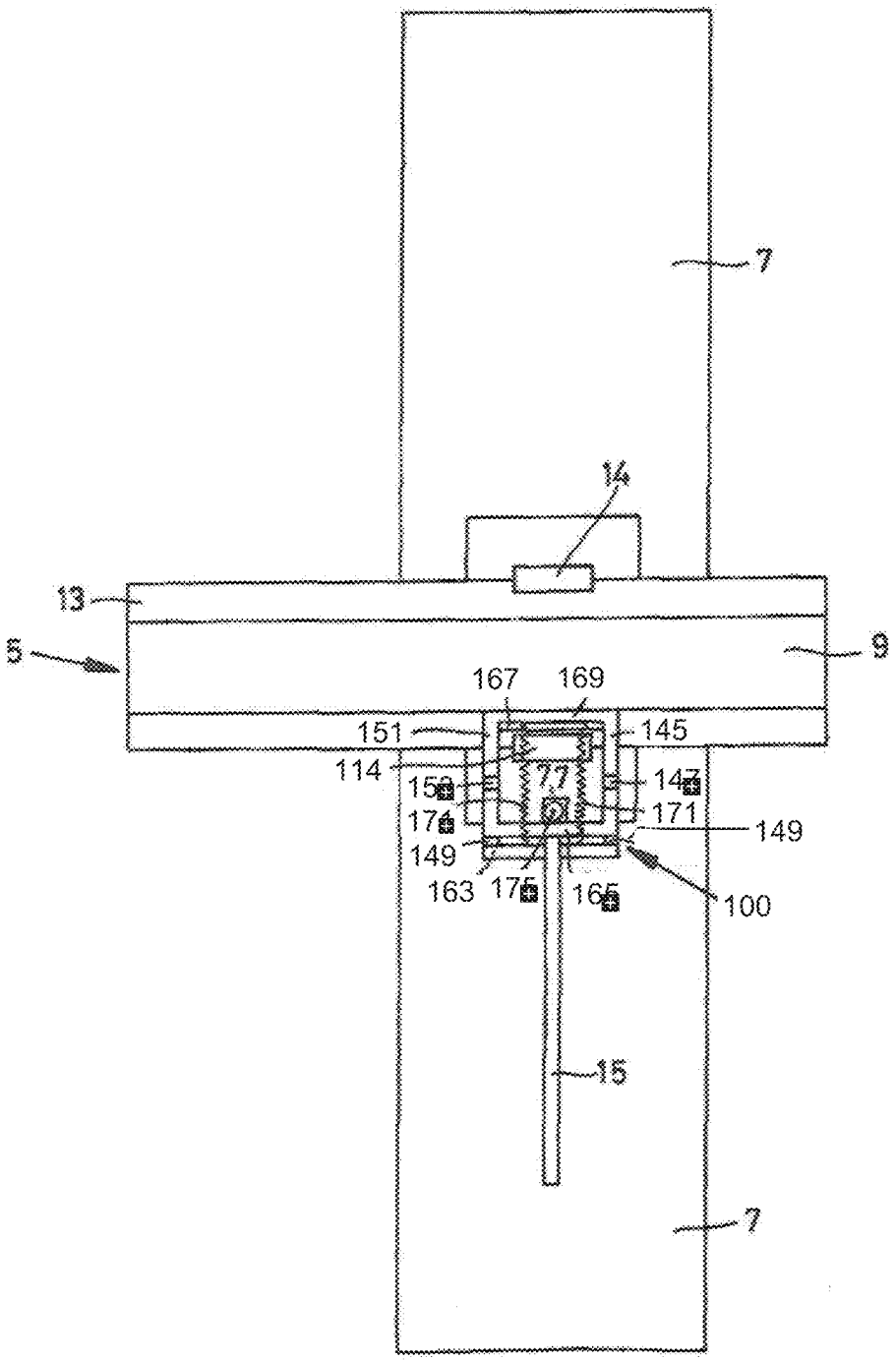

FIG. 3 is a schematic top plan view of the rail-mounted clamping mechanism shown in FIGS. 2*a, b, c*.

Figure 4A:
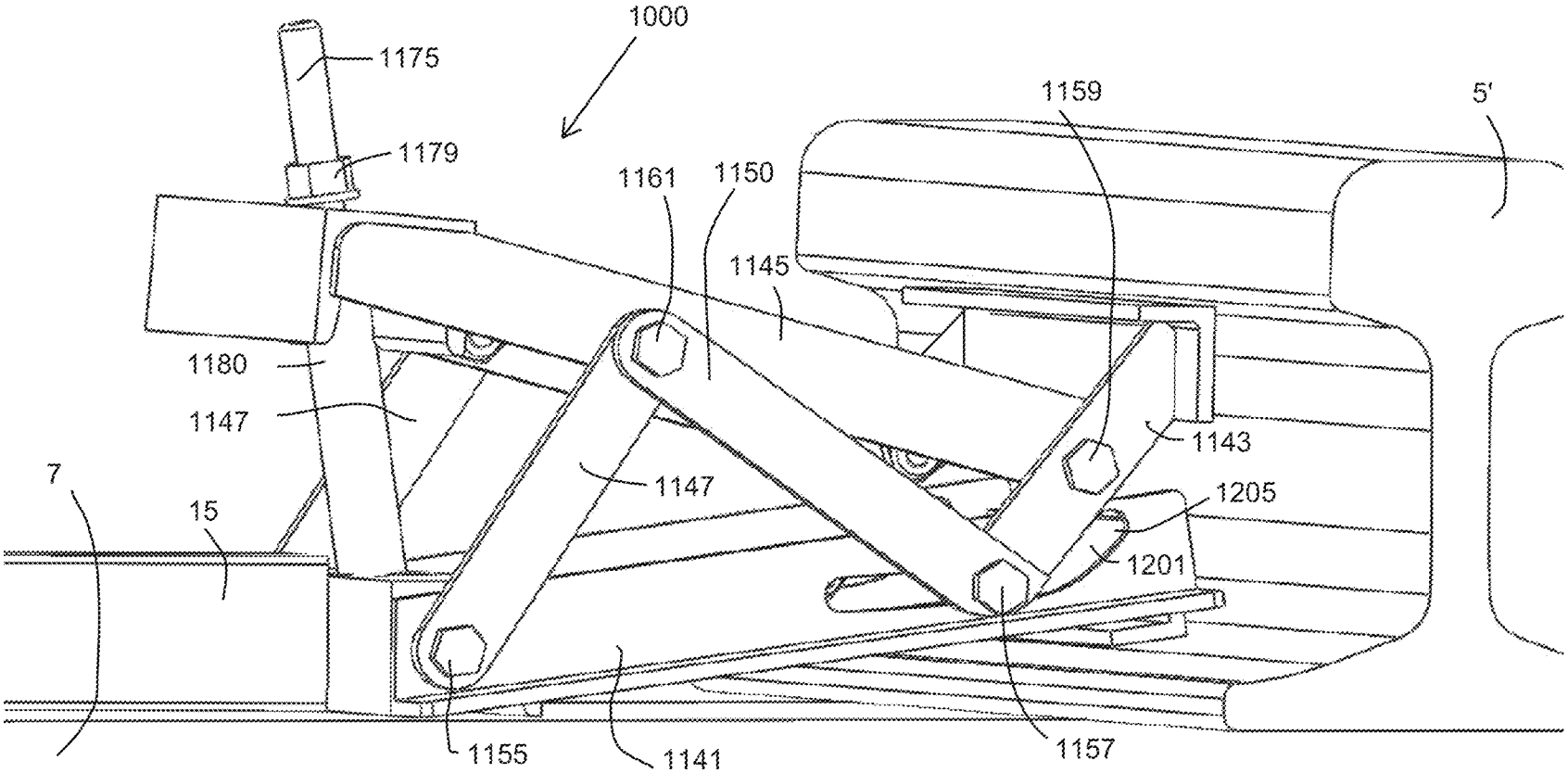
Figure 4B:
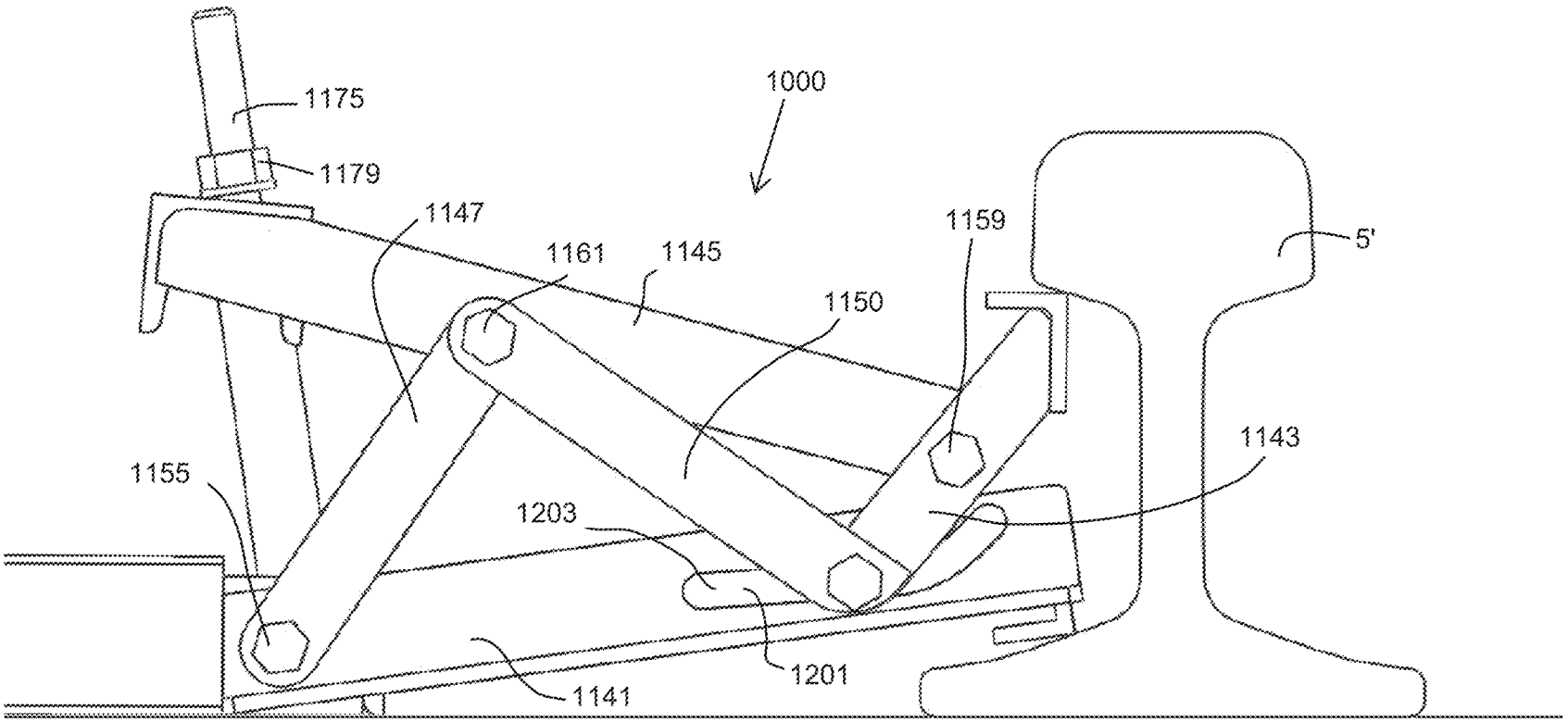

FIGS. 4*a*, 4*b* are views showing an alternative embodiment of the clamping mechanism according to the present invention.

Like parts are indicated by the same numerals in the various figures.

FIG. 1 shows a perspective view of a clamping mechanism 1 as known from NL-1030000. For a description of the operation of said clamping mechanism, reference is made to said patent document. The clamping mechanism according to the present invention is an improvement of the clamping mechanism that is known from NL-1030000. The use of the clamping mechanism according to the present invention, viz. in the installation of a temporary barrier 3 near a railway rail 5, is identical, however, and corresponding parts of the clamping mechanism according to the present invention are indicated by the same numerals in FIGS. 2 and 3.

In FIG. 1, two clamping mechanisms 1 are used for the (temporary) attachment of the barrier 3 to the rail 5. The clamping mechanisms 1 are fixed some distance apart to the sleepers 7, which distance corresponds to the length of a barrier panel 29 to be installed.

FIGS. 2*a*, 2*b* and 2*c* are schematic views showing the securing of the clamping mechanism 100 according to the present invention to the rail 5. FIG. 3 furthermore shows a schematic top plan view of the clamping mechanism 100 according to the present invention.

The clamping mechanism 100 comprises pivotally interconnected rods 141, 143, 145, 147, 149, 150, 151, 153, which assume a first shape for clamping down the clamping mechanism 1 in a U-shaped lateral section of the rail 5 (FIG. 2*a*). The rods 141, 143, 145, 147 are pivotable about pins 155, 157, 159, 161, comprising a bottom rod 141, an upper rod 145, a short rod 143, a fourth rod 147 disposed opposite the short rod, as well as two push rods 150. The push rod 150 shown in FIGS. 2*a*, 2*b*, 2*c* is directly connected to the bottom rod 141, the upper rod 145, the short rod 143 and the fourth rod 147 disposed opposite the short rod 143. The same applies to the second push rod (not shown in the figures). The phrase "directly connected" is understood to mean that two or more rods are connected by means of a single pivot pin. Furthermore, the bottom rod 147 is provided with a slot 201, in which the point of attachment or, in other words, the pivot pin 157, of the short rod 143 and the bottom rod 141 and the push rod 150, is accommodated so as to be movable in the longitudinal direction of the bottom rod 141.

The rods 141, 143, 145, 147 are connected, via connecting rods 163, 165, 167, 169 shown in FIG. 3, to an identical linkage 149, 151, 153 on an opposite side. Because of the top plan view, the push rod connected to the identical linkage 149, 151, 153 is not visible. The rod 141 and the opposite rod 149 and two connecting rods 163, 167 connecting said rods 141, 149 jointly form a rigid square base. Disposed opposite said base is an upper surface, which is likewise rigid and of square shape, being made up of two connecting rods 165, 169, the rod 145 as well as an opposite rod 151.

Attached to the connecting rod 163 of the base that is connected to the extension piece 15 are springs 71, which springs 71 are tensioned toward the connecting rod on 169 of the upper surface, which is to be placed under the rail head 9. Further connected to the connecting rod 163 of the base is a locking rod 175 that is pivotable about a pin 173. Attached to the connecting rod 165 of the upper surface that is located on the side of the extension piece 15 is a box beam 77. The locking rod 175 is attached to the connecting rod 165 by means of said box beam 77, which locking rod 175 is accommodated in the box beam 77 with some play. The locking rod 175 is a threaded rod 175 provided with screw thread, onto which a nut 179 can be screwed. The diameter of the opening in the box beam 77 is smaller than the diameter of the contact area of the nut 179. A device such as a washer may be used for increasing the contact area of the nut 179.

In the first position of the clamping mechanism 100, the nut 179 has been screwed back completely, or it may even have been screwed off the screw thread of the threaded rod 175 altogether. In the first position, the clamping mechanism 100 is made to assume a first shape (FIG. 2*a*) by means of the spring 171. The spring 171 exerts a pulling force in the direction indicated by the arrow P1 on the connecting rod 169 of the upper surface. In the position of the clamping mechanism 100 that is shown in FIG. 2*a*, equilibrium of forces exists, because the spring force exerted on the linkage is eliminated by means of the threaded rod 175 that is connected to the linkage via the box beam 77.

To adjust the clamping mechanism 100, the connecting rod 167 of the base is placed on the rail foot 13, between the web portion 11 and the fixing element 14 by means of which the rail is fixed to the sleeper 7, in the first position.

By screwing the nut 179 onto the threaded rod 175 in the direction indicated by the arrow P2, the nut 179 comes into contact with the box beam 77 that is attached to the connecting rod 165 (FIG. 2*b*). Upon adjustment of the clamping mechanism 100 from the first position to the second position by means of the nut 179, the threaded rod 175 is pivoted about the pin 173 in the direction indicated by the arrow P3. Upon tightening in the direction indicated by the arrow P2 of the nut 179 that abuts against the box beam 77, the connecting rod 165 of the upper surface is pivoted against the spring force of the spring 171. The movement of the connecting rod 165 causes the rods 143, 145, 147, 151, 153 connected thereto to pivot about the pins 155, 157,159, 161 to the second position of the clamping mechanism (schematically shown in FIG. 2*c*). More in particular, the push rod 150 is operated by tightening the nut 179, so that the point of attachment formed by the pivot pin 157 of the short rod 143 to the bottom rod 141, the push rod 150 as well as the connecting rod 167 will move in the longitudinal direction, in the direction indicated by arrow P4, from a first end of the slot 201 to a second end of the slot 201, with the shape of the clamping mechanism being adapted so that it is clamped down in the lateral section of the rail 5 in a force-locked manner. As a result of the movement of the point of attachment formed by the pivot pin 157, the connecting rod 167 is moved with respect to the fixing element 14, as a result of which the clamping mechanism 100 can be clamped down even more firmly in the lateral section of the rail 5.

The provision of the pivot pin 157 that is movable within the slot 201 facilitates the positioning of the clamping mechanism 100 in a lateral section of a rail 5, since the clamping mechanism 100, in addition to making a pivoting movement for changing the shape of the linkage, can make a linear movement with the point of attachment/the pivot pin 157 for changing the shape of the linkage. In this way a more flexible clamping mechanism 100 is provided, which can be used with a relatively large number of rail types of varying dimension for securing an object, such as the barrier shown in FIG. 1.

Upon adjustment of the clamping mechanism 100 from the first position to the second position, the connecting rod 167 is moved relative to the rail foot 13 towards the fixing element 14. In the second position as shown in FIG. 2*c*, the clamping mechanism is firmly clamped between the fixing element 14/the rail foot 13, and the web portion 11 of the rail 5.

As shown in FIG. 2*b*, an electric power wrench 81 may be used for tightening the nut 179, during which operation the operator may additionally place his foot 83 on one of the rods.

After the clamping mechanism 100 has been attached to the rail 5, the supporting arm 19 may be connected to the extension piece 15 in the manner described in the foregoing.

The threaded rod 175 may be exchanged for a serrated fixing rod variant as known from NL 1030000.

The present invention is furthermore not limited to the placement of a (safety) barrier 3, but to the placement of an object. Said object may be a warning sign for engine drivers, which is to be provided temporarily, or form a framework for installing a covering across the track on which maintenance work is to be carried out.

The clamping mechanism 100 is preferably placed on a sleeper 7. Sleepers 7 are generally spaced a standard distance apart, so that no additional measuring operations for determining the required spacing between the clamping mechanisms 100 are needed if an accordingly dimensioned barrier 3 or barrier panel 29 is used.

In spite of that which is shown in the illustrated embodiments of the clamping mechanism 100, in which said clamping mechanism is clamped between the fixing element 14/the rail foot 13 and the web portion 11 of the rail 5 in the second position, an adequate clamping engagement can already be obtained, using the clamping mechanism according to the invention, by clamping down the clamping mechanism 100 between the rail head 9 and the fail foot 13 in a force-locked manner.

FIGS. 4*a* and 4*b* show an alternative embodiment of a clamping mechanism 1000 according to the present invention. In the situation shown in FIG. 4*a*, the clamping mechanism 1000 is in an intermediate position, between the first position and the second position. In the situation shown in FIG. 4*b*, the clamping mechanism 1000 is in the second position, in which the clamping mechanism is clamped down in the lateral section of the rail 5'. The clamping mechanism 1000 can be used with different rails of different dimensions and shapes.

In FIGS. 4*a*, 4*b* like parts are indicated by the same numerals augmented by 1000; only the differences will be discussed herein. From a constructional point of view, there are only three differences. The spring (not shown) that is to deliver the spring force that is needed in the clamping mechanism 1000 surrounds the locking rod 1175 and is in turn surrounded and retained by a sleeve 1180. Because of the provision of the sleeve 1180, no parts can become tangled with the spring, which makes the clamping mechanism more user-friendly. In addition, only one spring is needed for the clamping mechanism 1000. The second difference is that the short rod 1143 is not connected to the upper rod 1145 near its end but approximately in the centre, via the pin 1159. The third difference is the configuration of the slot 1201, in which the point of attachment 1157 is movably accommodated. The slot 201 shown in FIGS. 2*a-c* extends parallel to the central axis of the bottom rod 141, so that the point of attachment can move linearly within the slot 201.

The slot 1201 is built up of two parts:

- a first part 1203 (the left-hand part in the views shown in FIGS. 4*a*, 4*b*) of the slot 1201, which part 1203 includes an acute angle with the central axis of the bottom rod 1141 or possibly the upper rod if the slot 1201 is provided therein, with the point of attachment 1157 being linearly movable within said first part 1203;
- a second part 1205 (the right-hand part in the views shown in FIGS. 4*a*, 4*b*) of the slot 1201, which has a curved shape, so that the point of attachment 1157 can move curvilinearly.

The first part 1203 automatically merges with the second part 1205 of the slot 1201. When a slot 1201 configured in this manner is used, the clamping mechanism 1000 can be used with an (even) larger number of differently dimensioned rails 5, 5'. Moreover, this configuration of the slot 1201 makes it possible to achieve an optimum clamping force in the lateral section of the rail 5'.

It is also possible to configure the first part 1203 so that the first part 1203 of the slot extends parallel (not shown) to the central axis of the bottom rod 1141 or the upper rod 1145 (if the slot is provided therein).

Instead of using a slot 201 it is also possible, of course, to use another mechanism for realising linear and/or curvilinear movement of the pivot pin 157 in the longitudinal direction of the bottom rod 141.

It is also possible to use only one push rod 150 rather than two push rods in a clamping mechanism, in which case said one push rod may only be connected to the connecting rod 167.

The invention claimed is:

1. A clamping mechanism for securing an object to a rail having a rail foot, a rail web coupled to the rail foot, and a rail head coupled to the rail web, the clamping mechanism comprising an upper linkage arm, a bottom linkage arm spaced apart from the upper linkage arm, a support linkage arm pivotally interconnected to the upper linkage arm and pivotally interconnected to the bottom linkage arm, and a sliding linkage arm having a first end coupled to the upper linkage arm and a second end positioned to engage and slide along the bottom linkage arm, the upper, bottom, support, and sliding linkage arms defining a quadrangle, wherein the sliding linkage arm is movable between a first position where the clamping mechanism is disengaged from the rail and a second position where the clamping mechanism is engaged with the rail such that the sliding linkage arm forces the upper linkage arm against the rail head and forces the bottom linkage arm against the rail foot to secure the clamping mechanism to the rail.

2. A clamping mechanism according to claim 1, characterised in that the clamping mechanism further comprises a spring coupled across the quadrangle formed by the upper, bottom, support, and sliding linkage arms such that the sliding linkage arm is movable against a spring force supplied by the spring and a pivotable locking rod coupled between the upper linkage arm and the bottom linkage arm to move the sliding linkage arm between the first position and the second position.

3. A clamping mechanism according to claim 1, characterised in that the clamping mechanism further comprises a pusher linkage arm coupled to the sliding linkage arm and coupled to at least one of the upper linkage arm, bottom linkage arm, and support linkage arm.

4. A clamping mechanism according to claim 1, characterised in that the bottom linkage arm is formed to include a slot extending in a longitudinal direction, and wherein the second end of the sliding linkage arm slides along the slot.

5. A clamping mechanism according to claim 4, characterised in that said slot extending in the longitudinal direction is fully surrounded by the bottom linkage arm in which the slot is provided.

6. A clamping mechanism according to claim 4, characterised in that said slot extends parallel to a central axis of the bottom linkage arm so that the second end of the sliding linkage arm is linearly movable.

7. A clamping mechanism according to claim 4, characterised in that only part of the slot extends parallel to a central axis of the bottom linkage arm.

8. A clamping mechanism according to claim 4, characterised in that at least part of the slot includes an acute angle with respect to a central axis of the bottom linkage arm.

9. A clamping mechanism according to claim 8, characterised in that at least part of the slot has a curved shape, so that the second end of the sliding linkage arm can move curvilinearly.

10. A barrier provided with at least one clamping mechanism according to claim 4.

11. A clamping mechanism for securing an object to a rail having a rail foot, a rail web coupled to the rail foot, and a rail head coupled to the rail web, the clamping mechanism comprising an upper linkage arm, a bottom linkage arm spaced apart from the upper linkage arm, a support linkage arm pivotally interconnected to the upper linkage arm and pivotally interconnected to the bottom linkage arm, and a sliding linkage arm having a first end coupled to the bottom linkage arm and a second end positioned to engage and slide along the upper linkage arm, the upper, bottom, support, and sliding linkage arms defining a quadrangle, wherein the sliding linkage arm is movable between a first position where the clamping mechanism is disengaged from the rail and a second position where the clamping mechanism is engaged with the rail such that the sliding linkage arm forces the upper linkage arm against the rail head and forces the bottom linkage arm against the rail foot to secure the clamping mechanism to the rail.

12. A clamping mechanism according to claim 11, characterised in that the clamping mechanism further comprises a spring coupled across the quadrangle formed by the upper, bottom, support, and sliding linkage arms such that the sliding linkage arm is movable against a spring force supplied by the spring and a pivotable locking rod coupled between the upper linkage arm and the bottom linkage arm to move the sliding linkage arm between the first position and the second position.

13. A clamping mechanism according to claim 11, characterised in that the clamping mechanism further comprises a pusher linkage arm coupled to the sliding linkage arm and coupled to at least one of the upper linkage arm, bottom linkage arm, and support linkage arm.

14. A clamping mechanism according to claim 11, characterised in that the upper linkage arm is formed to include a slot extending in a longitudinal direction, and wherein the second end of the sliding linkage arm slides along the slot.

15. A clamping mechanism according to claim 14, characterised in that said slot extends parallel to a central axis of the upper linkage arm so that the second end of the sliding linkage arm is linearly movable.

16. A clamping mechanism according to claim 14, characterised in that only part of the slot extends parallel to a central axis of the upper linkage arm.

17. A clamping mechanism according to claim 14, characterised in that at least part of the slot includes an acute angle with respect to a central axis of the upper linkage arm.

18. A clamping mechanism according to claim 17, characterised in that at least part of the slot has a curved shape, so that the second end of the sliding linkage arm can move curvilinearly.

19. A clamping mechanism according to claim 14, characterised in that the clamping mechanism further includes a barrier coupled to the bottom linkage arm.

20. A clamping mechanism for securing an object to a rail having a rail foot, a rail web coupled to the rail foot, and a rail head coupled to the rail web, the clamping mechanism comprising an upper linkage arm, a bottom linkage arm spaced apart from the upper linkage arm, a support linkage arm pivotally interconnected to the upper linkage arm and pivotally interconnected to the bottom linkage arm, a sliding linkage arm having a first end coupled to one of the bottom linkage arm and upper linkage arm and a second end positioned to engage and slide along a slot formed in the other one of the bottom linkage arm and upper linkage arm, and a pusher linkage arm coupled to the sliding linkage arm and coupled to at least one of the upper linkage arm, bottom linkage arm, and support linkage arm, wherein the upper, bottom, support, and sliding linkage arms defining a quadrangle, and the sliding linkage arm is movable between a first position where the clamping mechanism is disengaged from the rail and a second position where the clamping mechanism is engaged with the rail such that the sliding linkage arm forces the upper linkage arm against the rail head and forces the bottom linkage arm against the rail foot to secure the clamping mechanism to the rail.

* * * * *